United States Patent [19]

Lalancette et al.

[11] Patent Number: 4,519,811

[45] Date of Patent: May 28, 1985

[54] CALCINED SERPENTINE USEFUL AS SANDBLASTING AGENT

[75] Inventors: Jean M. Lalancette; Jean P. Chevalier-Bultel; Normand Labonte, all of Sherbrooke, Canada

[73] Assignee: Societe Nationale de l'Amiante, Quebec, Canada

[21] Appl. No.: 613,403

[22] Filed: May 24, 1984

[51] Int. Cl.[3] ..... C09C 1/68

[52] U.S. Cl. ..... 51/309; 51/308; 106/38.3; 106/38.9

[58] Field of Search ..... 51/308, 309; 106/38.3, 106/38.9

[56] References Cited

U.S. PATENT DOCUMENTS

| | | | |
|---|---|---|---|
| 3,765,923 | 10/1973 | Bender-Christensen | 51/309 |
| 3,816,086 | 6/1974 | Ceremsak et al. | 51/308 |
| 3,939,613 | 2/1976 | Ayers | 51/308 |

*Primary Examiner*—Paul Lieberman
*Assistant Examiner*—Willie Thompson
*Attorney, Agent, or Firm*—Cushman, Darby & Cushman

[57] ABSTRACT

There is provided a sintered angular shape granular sandblasting material obtained by the calcination of asbestos tailings at a temperature of from 1300° C. to 1450° C., said asbestos tailings being characterized by having a $MgO:SiO_2$ ratio lower than 1.0, the granular sandblasting material being characterized by a cold compression mechanical strength of from 10 to 160 MPa, by a granulometry of −40 to +150 mesh (Tyler), and by being substantially free of dust.

1 Claim, No Drawings

CALCINED SERPENTINE USEFUL AS SANDBLASTING AGENT

PRIOR ART

Silica in the form of quartz particles is a material of general use in sandblasting applications.

In sandblasting operations, the grain of silica is advantageous because it is efficient as an abrasive medium. A high speed stream of silica particles has been found useful for the removal of scale and rust from iron and steel, thus generating a clean and roughened surface appropriate for machining or coating.

As a sandblasting agent, silica presents a certain number of drawbacks:

Silica, specially in processes where new surfaces are generated on the silica grains by either abrasion or impact, has been found extremely active where in contact with living organism. This is particularly true when silica dust is inhaled, such conditions being held responsible for silicosis, a widely spread disease in areas exposed to high level of silica dust.

Secondly, on a technical point of view, silica used for sandblasting is obtained by mining deposits of silic which is then sieved and sometimes ground to proper mesh size before use. These operations fracture silica particles leaving their structure weakened by microfractures, thus rending said particles rather fragile upon impact. This relative weakness of the silica grains explains the large amount of dust generated when the material is used under conditions of severe mechanical attrition. The friability of silica grains when used for sandblasting prevents its recycling, thus adding substantially to the cost of the operation.

It should also be appreciated that the handling of silica for sandblasting purposes necessarily generates dust and thus represents a major industrial health problem. Dust from silica is known to be responsible for the serious diseases known as silicosis.

SUMMARY OF THE INVENTION

In accordance with the present invention the drawbacks of natural silica grains used in sandblasting operations is unexpectedly overcome by providing a modified serpentine granular material.

The present invention provides a novel sintered angular shaped granular sandblasting material derived from the calcination of asbestos tailings at a temperature of from 1300° to 1450° C., the starting asbestos tailings being characterized by an $MgO:SiO_2$ ratio lower than 1.0. Furthermore, the sandblasting material of the present invention is characterized by a cold compression mechanical strength of from 10.0 to 160 MPa and a granulometry in the range of −40 to +150 mesh (Tyler) and by being substantially free of dust, that is particles smaller than 200 mesh (Tyler).

DESCRIPTION OF THE INVENTION

Serpentine is an hydrated variety of magnesium silicate and occurs naturally in very large amounts, particularly as rejects or tailings from asbestos mining. A thermal treatment should in principle be able to transform this serpentine into an anhydrous magnesium silicate as follows:

$$\underset{\text{Asbestos tailings}}{3MgO.2SiO_2.2H_2O} \longrightarrow 3MgO.2SiO_2 + 2H_2O$$

However, it is well known to those familiar in the art of calcined products that a calcining operation of serpentine, especially when accompanied by gas evolution from the calcined species, may lead to a very fragile and porous entity.

For example, in the course of the manufacture of quick lime, limestone, a relatively hard and dense material, is transformed into a friable and porous mass by loss of carbon dioxide.

When serpentine tailings are calcined at a temperature required for its dehydration, between 750° and 850° C., we have noted a pattern similar to limestone has been noted whereby the mass becomes quite soft and easily converted into fine dust following the thermal treatment.

The heat treatment at 750° C. to 850° C. is quite efficient for the removal of any residual chrysotile fibers from those tailings, but the end product is next to useless as sandblasting material because of its softness and poor mechanical strength.

An obvious solution to this weakness of the calcined material would be to raise the calcining temperature to such a value that there would be a partial melting of the magnesium silicate in order to generate a ceramic bond between the particles. Upon examination of the phase diagram for the system $MgO/SiO_2$, one can note that the melting temperature for the $3MgO.2SiO_2$ is in the area of 1700°–1800° C. Such a high temperature of fusion therefore precludes the economical use of a material calling for such treatment.

However, contrary to what could be expected from the $3MgO.2SiO_2$ system, it has been found that a thermal treatment at a much lower temperature, in the range of 1250° to 1325° C., gave a highly sintered material having excellent mechanical properties, allowing its use as sandblasting foundry sands. The examination under microscope shows that grains of calcined tailings are quite angular in their shape and very different from the smooth surface of mined sand which has acquired a polished surface by attrition of the asperities over the ages.

Without going into limitative theoretical considerations, we can explain this unexpected case of ceramic bonding by a close examination of the chemistry involved in the course of the thermal treatment. It must be noted here that a serpentine tailing contains, beside MgO and $SiO_2$, up to 9% of iron oxides expressed as FeO and $Fe_2O_3$ combined. When the material is subjected to heat, the first reaction is a dehydration as noted above.

$$3MgO.2SiO_2.2H_2O.n(FeO.Fe_2O_3) \xrightarrow{750\text{–}850^\circ\ C.} 2H_2O + 3MgO.2SiO_2.n(FeO, Fe_2O_3)$$

This dehydration is completed at 900° C. Above that temperature, the production of forsterite predominates, up to 1200° C. This production of forsterite is accompanied by an evolution of free silica.

$$2[3MgO.2SiO_2.n(FeO, Fe_2O_3)] \xrightarrow{900\text{–}1200^\circ\ C.}$$

-continued $$3[(2MgO.SiO_2).\tfrac{2}{3}n(FeO, Fe_2O_3)] + 0\ SiO_2$$

Forsterite Free Silica

As the temperature reaches 1300° C., the system evolves towards the production of enstatite which is, in fact, a recombination of previously liberated silica with forsterite. This reaction is known to be rapid above 1300° C.

$$2MgO.SiO_2 + SiO_2 \xrightarrow{1300°\ C.} 2(MgO.SiO_2)$$

Forsterite Enstatite

The mixture of forsterite and enstatite in the proportion delimited by the starting serpentine has a very high melting point above 1700° C. as indicated before. However, the presence of iron oxides in the tailings allows the formation of rather fusible iron silicates such as gruenerite and fayalite. Therefore, we explain the unexpected low sintering temperature of serpentine tailings by the formation of gruenerite (iron metasilicate) and fayalite (iron orthosilicate) from the silica made available by the production of forsterite and the already present iron oxides.

For the contemplated uses of calcined tailings, the hardness of grains is always a consideration of importance. However, in the case of sandblasting material, the requirement on hardness becomes the determinant factor. It has been noted that the basicity index ($1\beta$) which is the MgO to $SiO_2$ ratio does vary from mine to mine. Also, it has been noted that a low basicity index ($MgO:SiO_2$ ratio) (i.e. $1\beta$ smaller than 1.00) corresponds to a lower refractoriness and an easier vitrification thus leading to a harder product obtained at lower temperatures.

This point is well illustrated by Table I, where the hardening resulting from sintering is noted for two different types of tailings of high and low basicity index.

Those results clearly show the advantage of using an acid tailings ($1\beta < 1$) if no refractoriness but rather great mechanical strength is required from the end product.

TABLE I

COMPARISON OF HEAT SINTERING OF TAILINGS

| Sources | Chem. Analysis MgO | $SiO_2$ | $1\beta$ | Cold compression strength (MPa) after firing at indicated temperature 1150° C. | 1200° C. | 1250° C. | 1300° C. | 1400° C. | 1440° C. |
|---|---|---|---|---|---|---|---|---|---|
| Bell Mines Quebec | 35% | 40.3% | 0.86 | 1.04 | 0.63 | 4.35 | 10.29 | 68.74 | 157.84 |
| Carey Mines Quebec | 40.5% | 37.1% | 1.09 | 2.02 | 1.98 | 2.02 | 1.93 | 2.48 | 4.73 |

It will be readily noted that Bell tailings ($1\beta = 0.86$) are advantageous for the production of sandblasting material because they are more easily sintered at a temperature of around 1300° C. The mechanical strength under those conditions is substantially higher than what is observed with more basic tailings as represented by Carey material ($1\beta = 1.09$).

SANDBLASTING

For sandblasting operation, two criteria are of paramount importance to obtain high performances, that is the hardness of grains and their angular shape. All other factors being kept equal, an angular material will lead to more efficient abrasion while a better hardness of the grains will allow a higher percentage of recycling of the sandblasting agent.

Since a tailings with a basicity index lower than one can be sintered at a lower temperature than basic tailings, it would be obvious to select such low basicity tailings as starting material. We have found in practice that tailings such as those of Bell Mine, with a basicity index of the order of 0.86, when fired for one hour at 1300° C., gave a high performance material for sandblasting.

The calcined material has to be sieved in order to give an adequate sandblasting agent. For coarse sandblasting, a granulometry of −16 to +60 mesh (Tyler) has been found adequate whereas for finer work including polishing, the mesh size can be from −40 to values as low as +150 mesh (Tyler).

Using standard methods in sandblasting industry, it has now been established that calcined tailings are more efficient than silica as sandblasting agent while generating less dust and being more easily recycled. Those advantageous performances are clearly shown by Tables II and III.

TABLE II

SANDBLASTING OF UNIT SURFACE OF MILD STEEL

| Material used for sandblasting | Mesh size (Tyler) | Unit surface cleaned/min. ($cm^2$/min.) Laboratory test | Field test |
|---|---|---|---|
| Calcined tailings Bell, 1300° C. | −16 +60 | 82.1 | 3716 |
| Silica Ottawa, round shaped grains | −30 +60 | 52.5 | 2601 |
| Silica Indusmin, angular shaped grains | −20 +50 | 79.7 | — |

TABLE III

REDUCTION OF MESH SIZE AFTER TEN RECYCLING OF A GIVEN LOT OF SAND

| | Calcined tailings Bell | | Ottawa | | Indusmin | | Slag | |
|---|---|---|---|---|---|---|---|---|
| | 1300° C. | | sand | | sand | | sand | |
| Mesh size (Tyler) | Initial (%) | 10 uses (%) | Initial (%) | 10 uses (%) | Initial (%) | 10 uses (%) | Initial (%) | 10 uses (%) |
| +20 | 43.7 | 15.7 | 0.2 | 0.2 | 18.0 | 0.5 | 20.7 | 5.4 |
| +30 | 28.5 | 24.7 | 9.7 | 5.0 | 41.7 | 4.1 | 32.8 | 11.3 |
| +40 | 15.1 | 23.0 | 43.6 | 38.3 | 20.6 | 8.6 | 20.5 | 12.6 |
| +50 | 12.6 | 12.8 | 13.6 | 21.6 | 12.3 | 11.0 | 13.7 | 11.9 |
| +60 | 0.1 | 3.9 | 20.3 | 5.9 | 3.4 | 6.0 | 4.5 | 5.6 |
| +80 | 0 | 5.0 | 11.1 | 7.4 | 2.7 | 10.7 | 4.3 | 8.7 |
| Dust | 0 | 14.9 | 1.5 | 21.6 | 1.3 | 59.1 | 3.5 | 44.5 |
| Total: | 100.0 | 100.0 | 100.0 | 100.0 | 100.0 | 100.0 | 100.0 | 100.0 |

It will be readily noted from Table II that material having round grains is not very efficient for sandblasting. The comparison of either calcined tailings or angular silica (Indusmin) to smooth silica is very illuminating on that point: the unexpected improvement obtained with a grain having an angular structure is of 50% over the smooth grains. It must be underlined that the ratio of field performances between calcined tailings and silica (1.42) is very close to the same ratio determined at a smaller scale, in laboratory test (1.56).

However, beside intrinsic abrading power, one must take into account the sturdiness of abrading grains since too soft a material will prevent economic recycling of the sandblasting agent. Examination of Table III shows clearly the advantage of using calcined tailings over other products that reveal themselves, upon use, as either too fragile or too friable to allow recycling. It is obvious that any material containing from 20 to 50% of fines is not worth a recycling operation.

From observations confirmed by field tests, it can be said that calcined tailings still can be used efficiently as sandblasting agent after 20 cycles whereas other material like silica cannot stand 10 cycles.

Therefore, it is obvious from these data that calcined tailings, because of their angular shape and good hardness resulting of sintering in the course of the firing operation, appear as a significantly superior material for sandblasting. Beside its intrinsic abrading performances, it generates less dust and allows recycling.

Table IV illustrates clearly the better hardness of grain shown by calcined tailings in comparison with a silica having an angular shape (Indusmin). This hardness must be understood as the resistance to fracture and is best appreciated by repetitive uses of the sand while evaluating the increase fraction of dust. Indusmin silica sand is used because its performances as an abrasive, as per Table II, are only slightly lower than calcined tailings. It will be readily noted that the attrition on the Indusmin sand is much more severe than in the case of calcined tailings.

TABLE IV

ATTRITION OF THE GRANULES PER CYCLE
Percent fraction smaller than 80 mesh (Tyler)

| Number of cycles | Calcined tailings Bell, 1300° C. | Indusmin |
|---|---|---|
| 0 | 0 | 1.3 |
| 2 | 2.98 | 11.57 |
| 4 | 5.66 | 22.96 |
| 6 | 8.81 | 35.21 |
| 8 | 12.09 | 48.05 |
| 10 | 14.9 | 59.1 |

It will be noted from Table IV that the rate of attrition is about 3.8 times less after two uses and about 4 times less after ten uses of calcined asbestos tailings when compared to Indusmin.

The present invention will be more readily understood by referring to the following Example.

EXAMPLE 1

In a Matfer® vacuum sandblasting chamber (5 pound chamber), a 30 cm by 30 cm mild steel plate heavily coated with rust was clamped. A stream of sandblasting tailings (prepared from tailings from Bell mine, $1\beta$: 0.86 and calcined at 1300° C., −16 mesh, +60 mesh Tyler) was directed from a 10 mm nozzle with an air presence of 100 psi. The angle of the stream in reference to the steel plate was 45° at a distance of 15 cm. The rate of cleaning of the surface was 82.1 $cm^2$/min. With Ottawa silica, the rate of cleaning was 52.5 $cm^2$/min. and with Indusmin sand, 79.7 $m^2$/min. In field tests the rate of cleaning was 3.716 $cm^2$/min. for the sandblasting tailings of the present invention and only 2.601 $cm^2$/min. for Ottawa round shaped grains.

What is claimed is:

1. A sintered angular shape granular sandblasting material obtained by the calcination of asbestos tailings at a temperature of from 1300° C. to 1450° C., said asbestos tailings being characterized by having a MgO:-$SiO_2$ ratio lower than 1.0, the granular sandblasting material being characterized by a cold compression mechanical strength of from 10 to 160 MPa, by a granulometry of −40 to +150 mesh (Tyler), and by being substantially free of dust.

* * * * *